US008674207B1

(12) United States Patent
Seymour

(10) Patent No.: US 8,674,207 B1
(45) Date of Patent: Mar. 18, 2014

(54) ELECTRONIC MUSICAL INSTRUMENT

(71) Applicant: Arthur Francis Seymour, Deerfield, IL (US)

(72) Inventor: Arthur Francis Seymour, Deerfield, IL (US)

(73) Assignee: Advins, Inc., Deerfield, IL (US)

( * ) Notice: Subject to any disclaimer, the term of this patent is extended or adjusted under 35 U.S.C. 154(b) by 0 days.

(21) Appl. No.: 13/650,563

(22) Filed: Oct. 12, 2012

(51) Int. Cl.
*G10H 7/00* (2006.01)

(52) U.S. Cl.
USPC ..... 84/615; 84/653

(58) Field of Classification Search
USPC ..... 84/615, 653
See application file for complete search history.

(56) References Cited

U.S. PATENT DOCUMENTS

| | | | | |
|---|---|---|---|---|
| 3,070,371 | A * | 12/1962 | Hearle | 273/287 |
| 5,076,131 | A * | 12/1991 | Patterson | 84/421 |
| 5,115,706 | A * | 5/1992 | Aluisi | 84/723 |
| 5,415,071 | A * | 5/1995 | Davies | 84/471 SR |
| 5,434,350 | A * | 7/1995 | Haney et al. | 84/743 |
| 5,741,990 | A * | 4/1998 | Davies | 84/423 R |
| 5,856,628 | A * | 1/1999 | Noguchi et al. | 84/738 |
| 7,030,305 | B1 * | 4/2006 | Cupid | 84/411 R |
| 7,696,421 | B1 * | 4/2010 | Charles | 84/411 R |
| 8,063,296 | B2 * | 11/2011 | Copeland et al. | 84/645 |
| 8,158,869 | B2 * | 4/2012 | Charles | 84/477 R |
| 8,163,992 | B2 * | 4/2012 | Charles | 84/615 |
| 8,207,435 | B2 * | 6/2012 | Charles | 84/471 R |
| 8,207,436 | B2 * | 6/2012 | Charles | 84/477 R |
| 2004/0035283 | A1 * | 2/2004 | King | 84/411 R |
| 2004/0200338 | A1 * | 10/2004 | Pangrle | 84/724 |
| 2006/0174756 | A1 * | 8/2006 | Pangrle | 84/724 |
| 2009/0013851 | A1 * | 1/2009 | Copeland | 84/411 R |
| 2010/0162875 | A1 * | 7/2010 | Charles | 84/477 R |
| 2010/0162876 | A1 * | 7/2010 | Charles | 84/483.2 |
| 2010/0180755 | A1 * | 7/2010 | Copeland et al. | 84/622 |
| 2011/0030535 | A1 * | 2/2011 | Charles | 84/483.2 |
| 2011/0030536 | A1 * | 2/2011 | Charles | 84/645 |
| 2011/0107899 | A1 * | 5/2011 | Charles | 84/483.2 |
| 2011/0185880 | A1 * | 8/2011 | Charles | 84/477 R |
| 2013/0192444 | A1 * | 8/2013 | Parsons et al. | 84/429 |

* cited by examiner

*Primary Examiner* — David S. Warren
(74) *Attorney, Agent, or Firm* — Justin Lampel

(57) ABSTRACT

The device relates to a circular electronic musical instrument having a keyboard with keys which produces polyphonic musical notes. The device is an organ which covers at least one octave of musical notes. The octaves are aligned in bands of concentric rings located on the top of the instrument. Each band of keys may contain one octave of notes. Notes in a first octave are next to or nearby identical notes in a second octave to make popular chords and songs easy to play. Notes may be played simultaneously which are octaves apart with one hand due to proximity of all the keys. A hand may extend over a centrally located loudspeaker and be used to vary the loudness and produce vibrato effects. A small overlay having information may be easily placed on the top of the keyboard to assist in learning songs by number, color, or other visual aids.

14 Claims, 9 Drawing Sheets

| Clock Frequency | | 2000240 | | 1000120 | | 500060 | |
|---|---|---|---|---|---|---|---|
| Note | Clk div. # | @Final/3 | @Out 3 | @Final/2 | @Out 2 | @Final/1 | @Out 1 |
| C# | 451 | 4435 | 2218 | 2218 | 1109 | 1109 | 554 |
| D | 426 | 4695 | 2348 | 2348 | 1174 | 1174 | 587 |
| D# | 402 | 4976 | 2488 | 2488 | 1244 | 1244 | 622 |
| E | 379 | 5278 | 2639 | 2639 | 1319 | 660 | 660 |
| F | 358 | 5587 | 2794 | 2794 | 1397 | 1397 | 698 |
| F# | 338 | 5918 | 2960 | 2960 | 1479 | 1479 | 740 |
| G | 319 | 6270 | 3135 | 3135 | 1568 | 1568 | 784 |
| G# | 301 | 6645 | 3323 | 3323 | 1661 | 1661 | 831 |
| A | 284 | 7043 | 3522 | 3522 | 1761 | 1761 | 880 |
| A# | 268 | 7464 | 3732 | 3732 | 1866 | 1866 | 933 |
| B | 253 | 7906 | 3953 | 3953 | 1977 | 1977 | 988 |
| C | 239 | 8369 | 4185 | 4185 | 2092 | 2092 | 1046 |
| | | IC3 Octave 7 | | IC2 Octave 6 | | IC1 Octave 5 | |

Figure 7
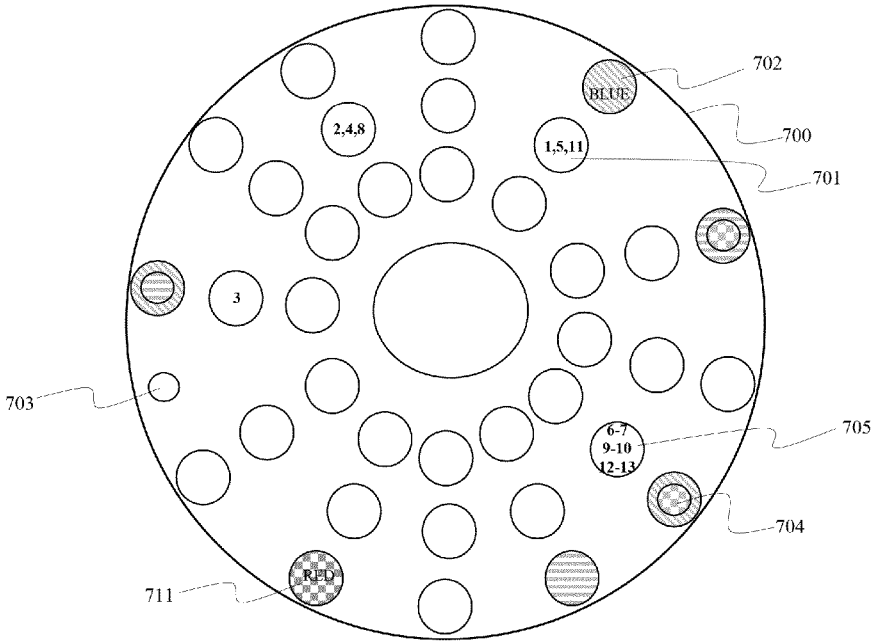
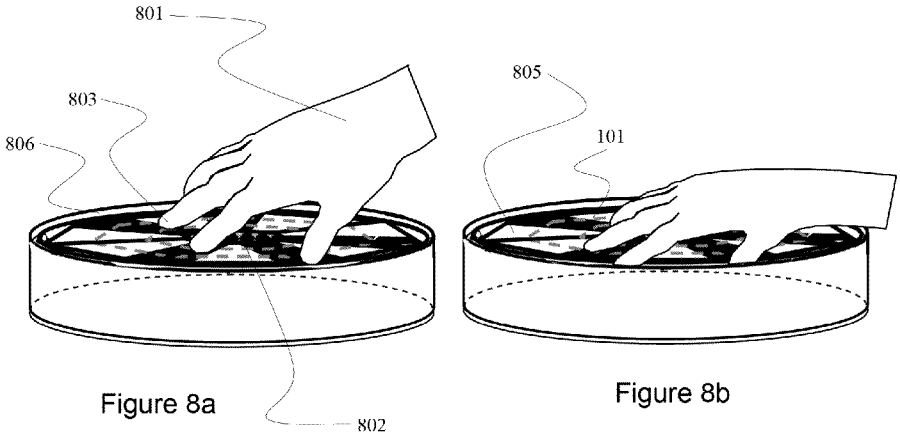
Figure 8a
Figure 8b 901 904 902 903

| Clock Frequency | 2380378 | | 1000120 | | 707168 | |
|---|---|---|---|---|---|---|
| Clk div. # | Note | @Out 3 | Note | @Out 2 | Note | @Out 1 |
| 451 then 2 | $E_7$ | 2639 | $C\#_6$ | 1109 | $G_5$ | 784 |
| 426 then 2 | $F_7$ | 2794 | $D_6$ | 1174 | $G\#_5$ | 830 |
| 402 then 2 | $F\#_7$ | 2960 | $D\#_6$ | 1244 | $A_5$ | 880 |
| 379 then 2 | $G_7$ | 3140 | $E_6$ | 1319 | $A\#_5$ | 933 |
| 358 then 2 | $G\#_7$ | 3325 | $F_6$ | 1397 | $B_5$ | 988 |
| 338 then 2 | $A_7$ | 3521 | $F\#_6$ | 1479 | $C_6$ | 1046 |
| 319 then 2 | $A\#_7$ | 3731 | $G_6$ | 1568 | $C\#_6$ | 1109 |
| 301 then 2 | $B_7$ | 3954 | $G\#_6$ | 1661 | $D_6$ | 1174 |
| 284 then 2 | $C_8$ | 4190 | $A_6$ | 1761 | $D\#_6$ | 1244 |
| 268 then 2 | $C\#_8$ | 4441 | $A\#_6$ | 1866 | $E_6$ | 1319 |
| 253 then 2 | $D_8$ | 4704 | $B_6$ | 1977 | $F_6$ | 1397 |
| 239 then 2 | $D\#_8$ | 4980 | $C_7$ | 2092 | $F\#_6$ | 1479 |
| | IC3 | | IC2 | | IC1 | |

900

905 906 907

ELECTRONIC MUSICAL INSTRUMENT

BACKGROUND OF THE INVENTION

The present device relates to a circular electronic musical instrument having a keyboard with keys which produces polyphonic musical notes. Specifically, the device is an organ which covers at least one octave of musical notes. The octaves are aligned in bands of concentric rings located on the top of the instrument. Each band of keys may contain one octave of notes. Notes in a first octave are next to or nearby identical notes in a second octave so as to make popular chords and songs easy to play. Notes may be played simultaneously which are octaves apart with one hand due to proximity of all the keys. A hand may extend over a centrally located loudspeaker and be used to vary the loudness and produce vibrato effects. A small overlay having information may be easily placed on the top of the keyboard to assist in learning songs by number, color, or other visual aids. A user may rotate the octaves individually by electronic means.

Electronic musical instruments which produce audible sounds using electronics are common. Such instruments typically make sounds by outputting an electrical audio signal that ultimately drives a loudspeaker. The loudspeaker (or "speaker") is generally an electro-acoustic transducer that produces sound in response to the electrical audio signal input.

An electronic musical instrument may include a user interface for controlling its sound, often by adjusting the pitch which is an auditory sensation in which a listener assigns musical tones to relative positions on a musical scale based primarily on the frequency of vibration. The user interface may also adjust the frequency, which is the number of occurrences of a repeating event per second and the duration of each frequency occurrence or note. French composer and engineer Edgard Varèse created a variety of compositions using electronic horns, whistles, and tape. Most notably, he wrote Poène Électronique for the Phillips Pavilion at the Brussels World Fair in 1958.

Electronic musical instruments are now widely used in most styles of music. Development of new electronic musical instruments, controllers, and synthesizers continues to be a highly active and interdisciplinary field of research. Specialized conferences, notably the "International Conference on New Interfaces for Musical Expression", have organized to report cutting edge work, as well as to provide a showcase for artists who perform or create music with new electronic music instruments, controllers, and synthesizers.

It is also known to provide electronic musical organs. For example, U.S. Pat. No. 4,291,603 to Katz discloses an electronic organ having a tone generating system for producing tones corresponding to notes of a musical scale. The tones and combinations thereof are selectable to provide different characteristics or "voices" which duplicate the various voices which are selectable on a pipe organ. The character of each such voice is determined by a single generator. The character of the output tone on a per manual basis is alterable by substituting or combining the outputs of different generators. The signal produced in this manner is sampled at a rate which translates it to an audio frequency. Early electric organ products released in 1930s/1940s were already implemented on frequency divider technology with vacuum tubes.

With the development of the transistor, a semiconductor device used to amplify and switch electronic signals and electrical power, electronic organs that used no mechanical parts to generate the waveforms became practical. The first of these was the frequency divider organ, the first of which used twelve oscillators to produce one octave of the chromatic scale, and frequency dividers to produce other notes. These were even cheaper and more portable than existing mechanical organs. Later developments made it possible to run an organ from a single frequency oscillator.

Frequency divider organs were built by many companies, and were offered in kit form to be built by hobbyists. A few of these have seen notable use, such as the Lowrey organ played by Eric Garth Hudson (b. Aug. 2, 1937) a Canadian multi-instrumentalist. As the organist, keyboardist and saxophonist for Canadian-American rock group "The Band", he was a principal architect of the group's unique sound. Its electronic design made the Lowrey organ easily equipped with a pitch bend feature that is unavailable for other non electronic organs, and Hudson built a style around its use.

Today there are toys and teaching aids that produce musical notes and chords. Many of these are used to amuse a child or teach some musical principle. Electronic organs currently being sold mostly consist of a rectangular shape with keys mounted in a straight layout or semi-circle to produce the notes. The keys in the top octave of the device are typically at one end of the keyboard and the keys in the lowest octave are typically at the other end of the keyboard. Playing notes octaves apart requires using both hands and movement of the eyes to see both keys to be played. Overlays on the keys become long and cumbersome. On these instruments the playing of notes separated by octaves does not leave a hand free to play rhythm or percussion keys. Changing the instrument sound during chords also cannot be accomplished easily when both hands are required to play the notes. When these organs are used by a child with small hands the difficulty factor in producing harmonious chords and melody at the same time is multiplied.

Being circular in shape, a steel pan/drum arranges notes in a circular fashion. In U.S. Pat. No. 8,207,435 to Charles discloses arrangements of tuned areas that cover three and four octaves using concentric bands for the tuned areas. The patent states "a tablature system for representing a series of notes to be played on a steel pan/drum having a plurality of concentric rings of note pads, wherein each note pad is capable of producing a distinct musical pitch when struck." A tool is required to strike these areas and produce the sounds when the steel pan/drum notes are desired. The notes played on a steel pan/drum do not have the advantages of electronic musical instruments such as enhanced musical effects like glissando, vibrato, timbrato, tremolo, echo, amplification, memory, and controlled fading to name a few.

SUMMARY OF THE INVENTION

The present device relates to a circular electronic musical instrument having a keyboard with keys which produces polyphonic musical notes. Specifically, the device is an organ which covers at least one octave of musical notes. The octaves are aligned in bands of concentric rings located on the top of the instrument. Each band of keys may contain one octave of notes. Notes in a first octave are next to or nearby identical notes in a second octave so as to make popular chords and songs easy to play. Notes may be played simultaneously which are octaves apart with one hand due to proximity of all the keys. A hand may extend over a centrally located loudspeaker and be used to vary the loudness and produce vibrato effects. A small overlay having information may be easily placed on the top of the keyboard to assist in learning songs by number, color, or other visual aids. A user may rotate the octaves individually by electronic means.

The present organ has a generally round shape and a top surface wherein the top surface has a centrally located loudspeaker. The organ may have a keyboard having a plurality of layers comprising: 1) a printed circuit board (or 'fourth layer') having a top surface wherein the musical note key sensors are located; 2) an insulating plastic overlay (or 'third layer') covering the top surface of printed circuit board; 3) an electrically conductive sheet (or 'second layer') located above the insulating plastic overlay; and 4) an optional visual overlay (or 'first layer') showing note locations on the instrument. Pluralities of octave note generating integrated circuits are coupled by electronic circuits to a plurality of discrete note pads on the surface of the printed circuit board. Frequency division is used to produce all the notes in one or more octaves simultaneously at the note pads on the printed circuit board. The notes are mixed by placing them on a conductive surface which is connected to an audio amplification system that is functionally equivalent to an electronic organ.

The organ has a double-sided printed circuit board having note pads located on the top side which may be depressed and electronics located on the bottom side (or opposite side) wherein the electronics generate the sound. The present device further has a conductive flexible layer (second layer) insulated from the top side of the double-sided printed circuit board by a thin non-conductive layer (the third layer). The third layer has openings above each note pad of the top side of the double-sided printed circuit board.

A musical note may be generated by pressing a key on the first layer of the keyboard. More specifically, the musical note may be created by the electrical shorting of the conductive flexible layer (second layer), through an opening in the non-conductive layer (third layer), to the double-sided printed circuit board (fourth layer). If each note source has an equivalent peak to peak voltage and resistance, and more than one note is pressed at the same time, the notes will mix on the conductive flexible sheet equally. The mixed peak to peak voltage will have the same peak to peak value as a single note. When the conductive second layer is shorted to the high resistance input of an audio amplifier which drives a loudspeaker, all the notes will be heard simultaneously.

The circular design of the organ also makes it possible to place a visual overlay on the top of the keyboard with numbers or colors to help a child or student play a song. Symmetry allows the rotation of this visual overlay to change the keys used when playing the song. Colors can be used to produce chords that match the melody at various parts of the song. The top of the device is substantially free of cracks or openings therein allowing the device to be largely water-resistant and suitable for use outside.

The present organ has a circular keyboard so as to minimize the distance between musical notes which therein allows a small hand to easily span many octaves of the musical scale. Placing the loudspeaker at the center of the circular keyboard allows a user to mute the audio level and create musical effects with the palm of one's hand Electronic means may also be included to modulate tone, pitch adjustment, loudness, memorize notes for a given time period, memorize whole songs, play prerecorded songs or speech, or change position of the notes on the circular keyboard. Mechanical means may also be provided to change keyboard appearance, position of notes, play songs by number and create chords by color.

An advantage of the present device is that the organ substantially lacks cracks, creases or openings and is therefore largely waterproof and suitable for use outside by marching bands.

Yet another advantage of the present device is that the circular keyboard design also makes it possible to place a rotatable visual overlay on the top of the keyboard with numbers or colors to help a child or student play a song.

Still another advantage of the present organ is that the location of the keys in any individual octave of the instrument may be electronically rotated with respect to the other octaves.

Still another advantage of the present organ is that all notes can be played simultaneously without changing the overall peak to peak amplitude of the output audio level.

Still another advantage of the present organ is that the symmetry and the location of the keys of the instrument allows the rotation of a visual overlay to change during the middle of the playing the song.

And another advantage of the present organ is that the visual overlay of the device may be color coded so as to allow a user to easily identify chords which match the melody at various parts of a song.

Yet another advantage of the present device is that the palm of the users hand may be used to mute or create a vibrato effect with respect to a centrally located loudspeaker while at the same time playing notes or chords.

Still another advantage of the present device is that the device may have loudspeakers located on the side of the device which produce sound without the users hand muting or creating a vibrato effect if the muting or vibrato effect is not desired.

Yet another advantage of the present device is that a user can elect between utilizing a centrally located loudspeaker, a side located loudspeaker or both.

For a more complete understanding of the above listed features and advantages of the electronic musical instrument reference should be made to the following detailed description of the preferred embodiments and to the accompanying drawings.

BRIEF DESCRIPTION OF FIGURES

FIG. 7 illustrates a visual overlay showing note numbers in a song and base chord colors.

FIGS. 8*a* and 8*b* illustrate a hand spanning over a centrally located loudspeaker of the keyboard.

DETAILED DESCRIPTION OF THE PREFERRED EMBODIMENT

The present device relates to a circular electronic musical instrument having a keyboard with keys which produces polyphonic musical notes. Specifically, the device is an organ which covers at least one octave of musical notes. The octaves are aligned in bands of concentric rings located on the top of the instrument. Each band of keys may contain one octave of notes. Notes in a first octave are next to or nearby identical notes in a second octave so as to make popular chords and songs easy to play. Notes may be played simultaneously which are octaves apart with one hand due to proximity of all the keys. A hand may extend over a centrally located loudspeaker and be used to vary the loudness and produce vibrato effects. A small visual overlay having information may be easily placed on the top of the keyboard to assist in learning songs by number, color, or other visual aids. A user may rotate the octaves individually by electronic means.

Figure 1:
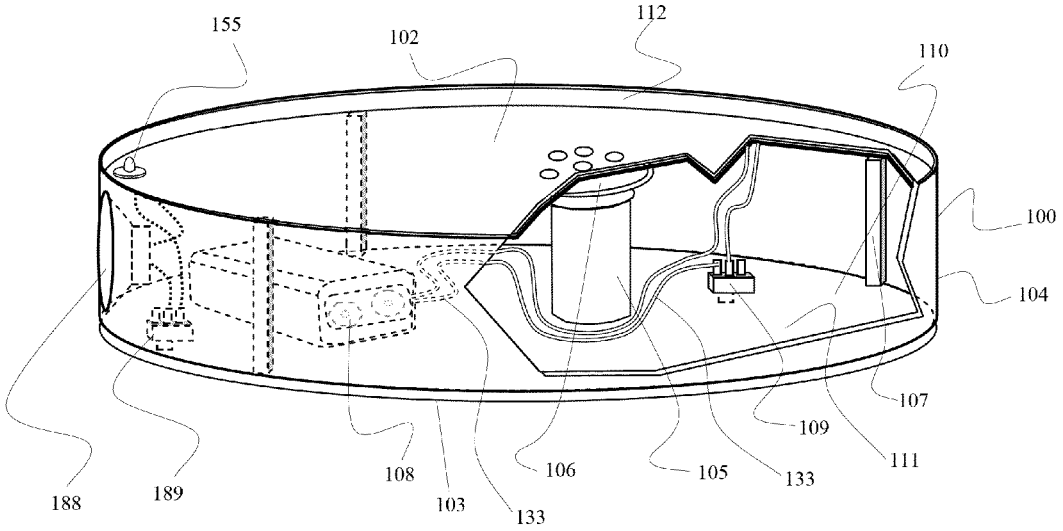
FIG. 1 illustrates a perspective view of the musical instrument wherein a section of wall is cutaway showing the interior of the instrument.

Referring now to FIG. 1, an electronic musical instrument 100 is provided. The musical instrument 100 may have a top 102, a bottom 103, a generally cylindrical exterior side surface 104 and an interior 111. The electronic musical instrument 100 may be substantially round in shape and may have a generally circular keyboard 101 (FIG. 3) having a plurality of keys 805 (FIG. 8*b*). In an embodiment, the plurality of keys 805 are generally trangular wherein the plurality of keys 805 become more narrow the closer to the center of the electrical musical instrument 100. The generally circular keyboard 101 may be located at the top 102 of the musical instrument 100 (FIG. 1 does not show the entire generally circular keyboard 101). The plurality of keys 805 may be arranged so as to produce octaves 507 (FIG. 5) of musical notes arranged in concentric rings or circles 309-311. A generally circular base 110 may be located at the bottom 103 of the device 100 and may provide structural support for electronic and non-electronic elements located within the interior 111 of the musical instrument 100.

The electronic musical instrument 100 may have an electronic loudspeaker 106, 203 located within the interior 111 of the device 100. In particular, the electronic loudspeaker 106, 203 may be located within the center of the concentric rings 309-311 of musical notes. Sound emitted from the electronic loudspeaker 106, 203 may extend upward through openings in the speakers so that the sound which exits the electronic loudspeaker 106, 203 is directed upward and away from the top 102 of the musical instrument 100. A hollow loudspeaker support 105 may be molded into the base 110 of the electronic musical instrument 100 (within the interior 111 of the device 100) and may extend upward. The hollow loudspeaker support 105 may secure the loudspeaker 106, 203 in position and may enhance the sound of the musical notes by providing a baffle for the loudspeaker 106, 203. Further, the hollow loudspeak support 105 may further provide structural support for the generally circular keyboard 101 located at the top 102 of the device 100.

An on-off switch 109 and a battery 108 may also be located within the interior 111 of the device 100 wherein the battery 108 and the on-off switch 109 are electrically connected to each other by an electrical wire 133. The battery 108 may provide power to all the electrical components of the musical instrument 100. A plurality of side rails 107 may be located within the interior 111 of the device 100, at the generally cylindrical exterior side surface 104. The plurality of side rails 107 may be secured to the base 110. The plurality of side rails 107 may support and secure the keyboard 101 at the top 102 of the musical instrument 100.

Figure 3:
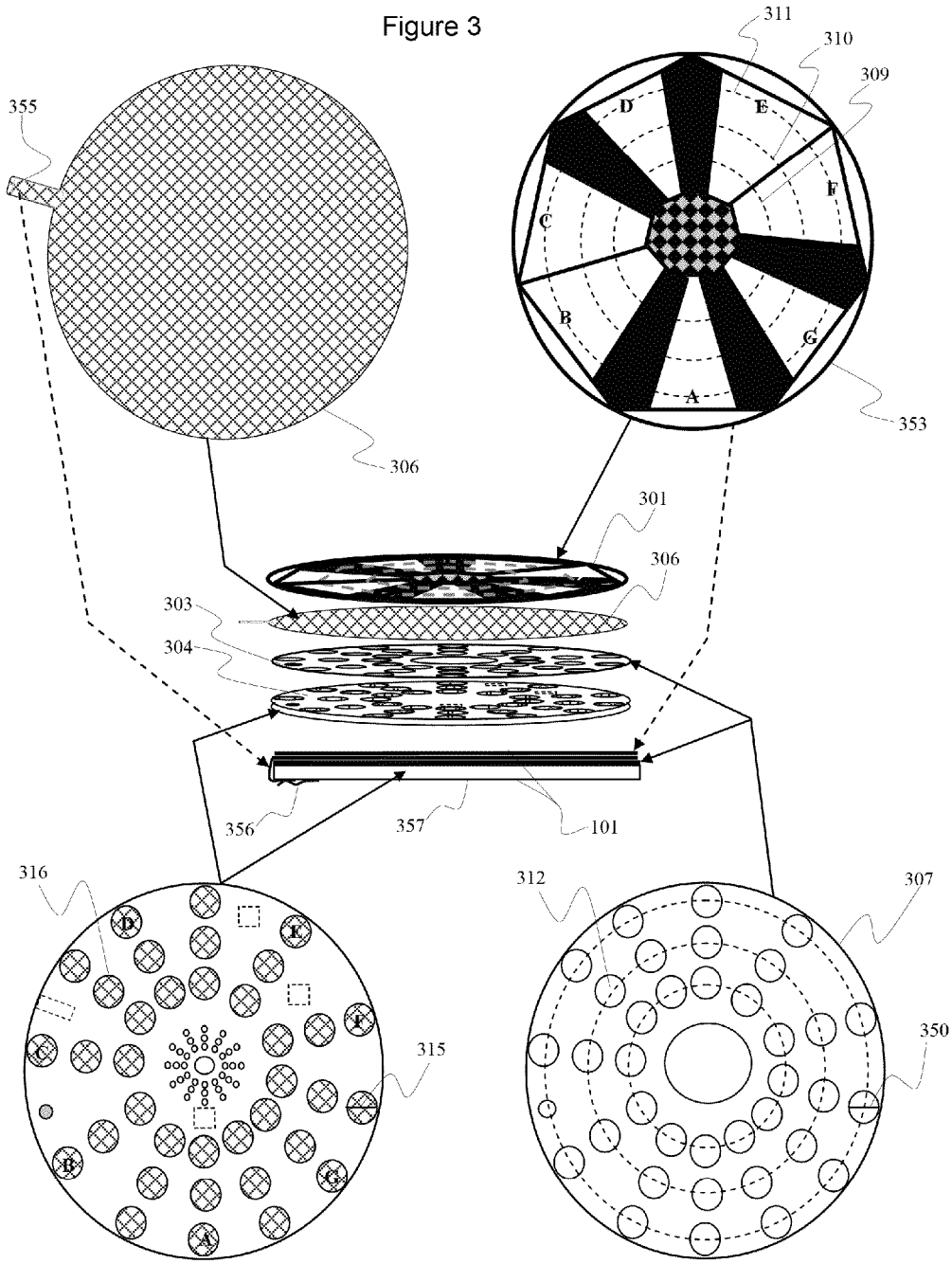
FIG. 3 illustrates the layers of the keyboard of the device.

Referring now to FIG. 3, the top 102 of the musical instrument 100 may be made from a plurality of layers together forming a keyboard 101. In an embodiment, four layers create the top 102 of the musical instrument 100. All four layers may be generally circular and may be substantially the same size as each other so that one layer substantially covers another layer. The first layer 301 may be the top 102 of the device 100 wherein a user actually manipulates the device 100. Further, the first layer 301 may be made from a flexible material such as plastic, paper, or rubber.

Figure 2:
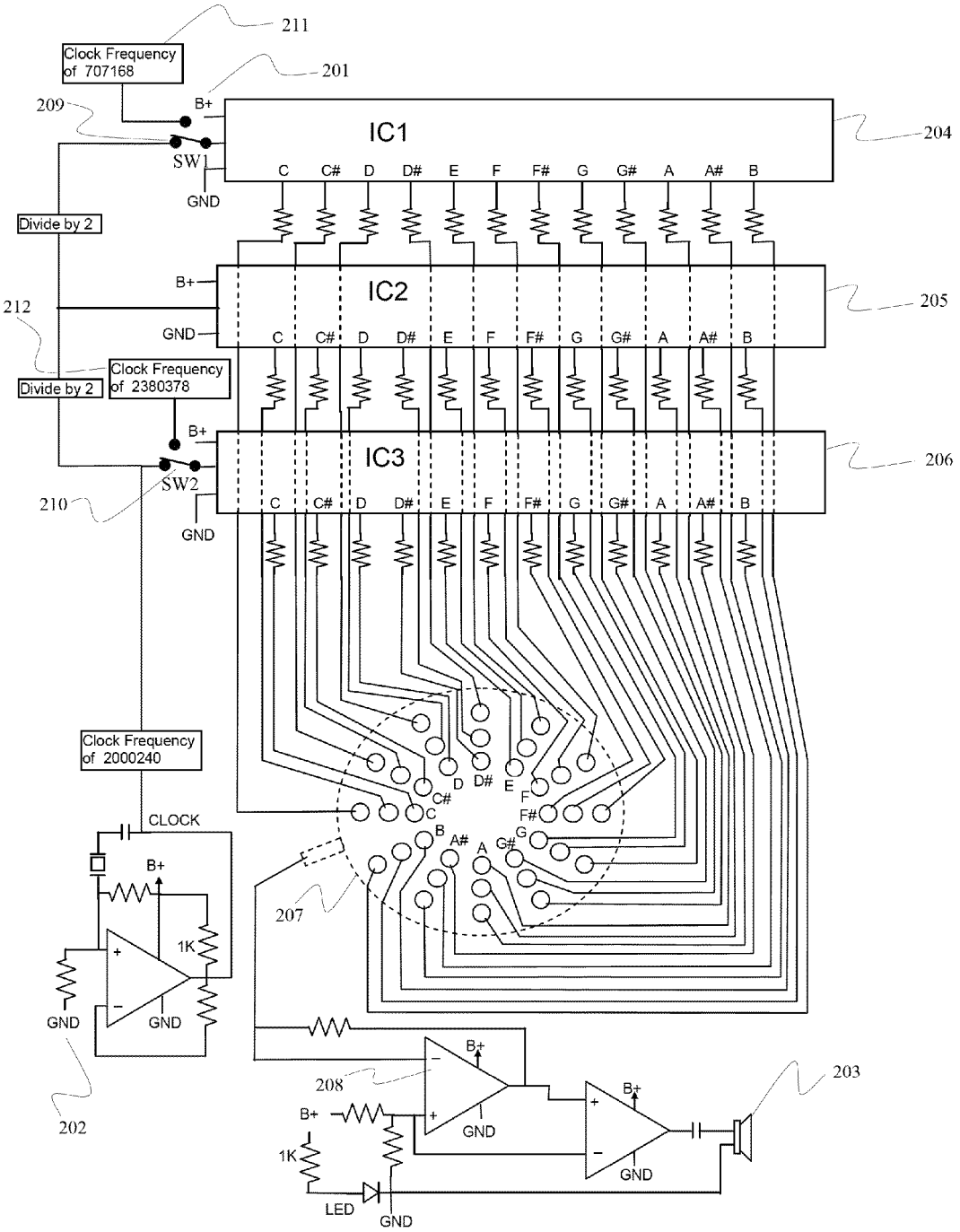
FIG. 2 illustrates a schematic diagram of the circuitry associated with the musical instrument wherein connections from DC voltage inputs to the speaker output are illustrated.

Beneath the first layer 301 may be a second layer 306 (207 in FIG. 2) which may be made from a flexible and fully conductive disc of metal such as aluminum or tin. The second layer 306, 207 may be flexible so as when a portion of the second layer 306, 207 is pressed down, an electrical contact with the fourth layer 304 may be made only at the area beneath where the second layer 306, 207 is depressed. In an embodiment, the second layer 306, 207 may have an outwardly extending tab 355. The outwardly extending tab 355 may be generally rectangular and may extend outward, away from the center of the second layer 306, 207.

In use, the outwardly extending tab 355 may be bent downward (forming an "L-shape") so that the outwardly extending tab 355 covers a portion of the side of the third layer 303 and a portion of the side of the fourth layer 304. Further, the outwardly extending tab 355 may partly wrap around the underside of the fourth layer 304 and may be secured to the fourth layer 304 by, for example a clip 356 located on the bottom 357 of the fourth layer 304.

The top of the second layer 306 may be secured to the underside of the first layer 301 by glue while the outwardly extending tab 355 of the second layer 306 may make electrical contact with the fourth layer 304. Further, an electrical connection is created between the outwardly extending tab 355 of the second layer 306 and the fourth layer 304. In particular, electrical information generated on the second layer 306 (by pressing on keys 805 located on the first layer 301 at specific locations) can be transferred to the fourth layer 304. The second layer 306,207 is not secured directly to the third layer 303 so as to allow the second layer 306,207 to stretch when pressure is applied by the finger 803 playing a note.

A third layer 303 of the keyboard 101 may be located beneath the second layer 306, 207 but not affixed to the second layer 306. The third layer 303 may be a plastic insulator located between the second layer 306 and the fourth layer 304 and may selectively insulate the electrical connection between the second layer 306, 207 and the fourth layer 304. The third layer 303 may have a plurality of concentrically arranged holes 312. The concentrically arranged holes 312 have a width 350 which is generally equal to or greater than the width of the fingertip 803 (FIG. 8*a*). Preferably, the width 350 is large enough so an adult or a small child may operate the instrument 100. As a result, a user may press on the area over the concentrically arranged holes 312 to activate the sound during use. The third layer 303 may be glued to the fourth layer 304 in a manner that places the concentrically arranged holes 312 of the third layer 303 over specific note pads 316 of the fourth layer 304.

Finally, the fourth layer 304 may be located beneath and affixed to the third layer 303. The fourth layer 304 may be a double-sided printed circuit board and may be thicker than the remaining layers of the keyboard 101. The fourth layer 304 may have a plurality of note pads 316, each of the note pads 316 having a diameter 315. The plurality of note pads 316 of the fourth layer 304 may be substantially the same size as the plurality of concentrically arranged holes 312 of the third layer 303. Further, the plurality of note pads 316 of the fourth layer 304 may be located directly below the plurality of concentrically arranged holes 312 of the third layer 303 such that the plurality of note pads 316 of the fourth layer 304 may be accessed (by the second layer 306) through the plurality of concentrically arranged holes 312 of the third layer 303.

To play the instrument 100 a user first presses on the first layer 301 of the keyboard 101. More specifically, a user presses his or her finger (or fingertip) 803 on the keys 805 of the first layer 301. When the keys 805 are depressed, the underside 353 of the keys 805 of the first layer 301 push a portion of the flexible conductive second layer 306 downward and force a portion of the conductive second layer 306 to make contact to the fourth layer note pads 316 through the plurality of concentrically arranged holes 312 in the third layer 303. When the user's finger 803 is released, the keys 805 and all the layers return to their original position and the notes are not played.

Figures 5, 6:
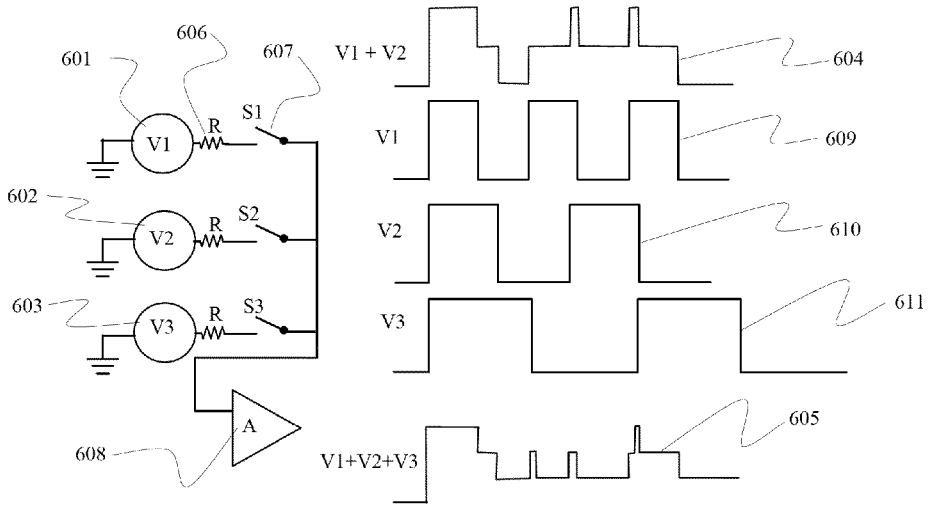
FIG. 5 illustrates a frequency chart showing an integrated circuit clock input and the output frequencies columns at printed circuit contact areas when octaves are not shifted.
FIG. 6 illustrates the note voltage mixes on a conductor sheet.

When pressure is applied by a finger 803, as described above, the fourth layer note pad 316 is shorted to the second layer 306 and the electrical circuitry of the device 100 sends a signal to the loudspeker 106 to produce a sound. If more than one key 805 is pressed at the same time, the musical notes on each note pad 316 will be added as shown in FIG. 6. When two keys 805 are pressed the voltages add as shown in FIG. 6 for V1 601, 609 plus V2 602, 610 to make the voltage V1+V2 604 which has three voltage levels but the same peak to peak voltage as both V1 609 and V2 610. When three of the note pads 316 are pressed at the same time the voltages from those note pads 316 add as shown in FIG. 6 as V1+V2+V3 605 with the third voltage V3 603, 610 making one more level in the shape of the sum V1+V2+V3 605. The peak to peak voltages always remain the same but the number of voltage levels in the sum of all the voltages equals the number of notes pressed plus one. These voltage levels will divide the peak to peak equally if all the resistors R 606 are equal in value. In an embodiment, the present musical instrument 100 is that the device 100 may be waterproof and therefore used outside by marching bands.

Figure 11:
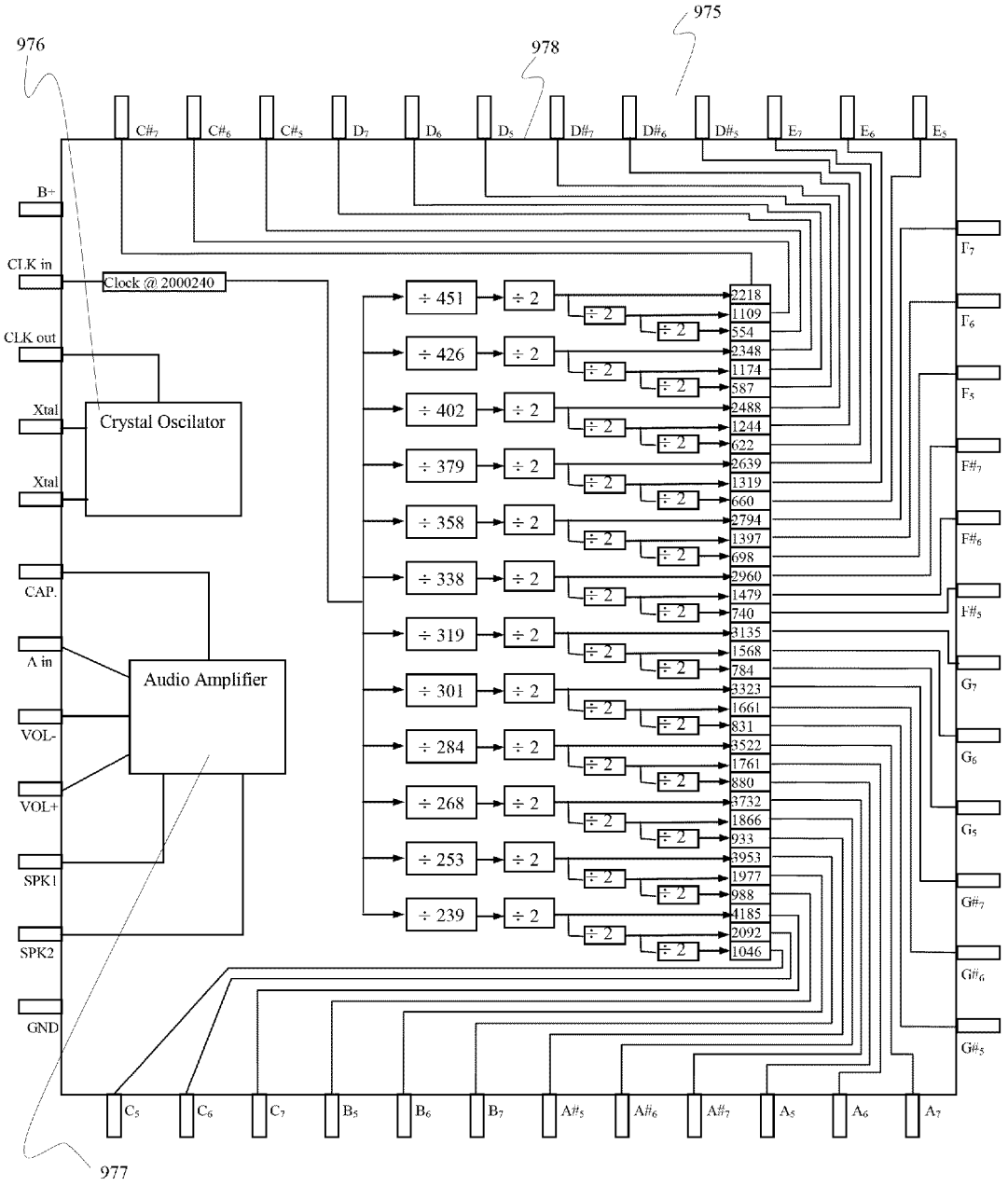
FIG. 11 illustrates an integrated circuit block diagram of a three octave generating circuit showing notes, clock frequency generator, and an audio circuit.
Figure 12:
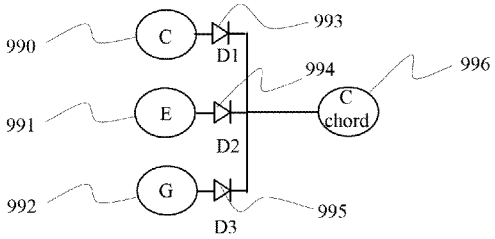
FIG. 12 illustrates a schematic for adding chord pads or keys to the musical instrument.
Figure 13:
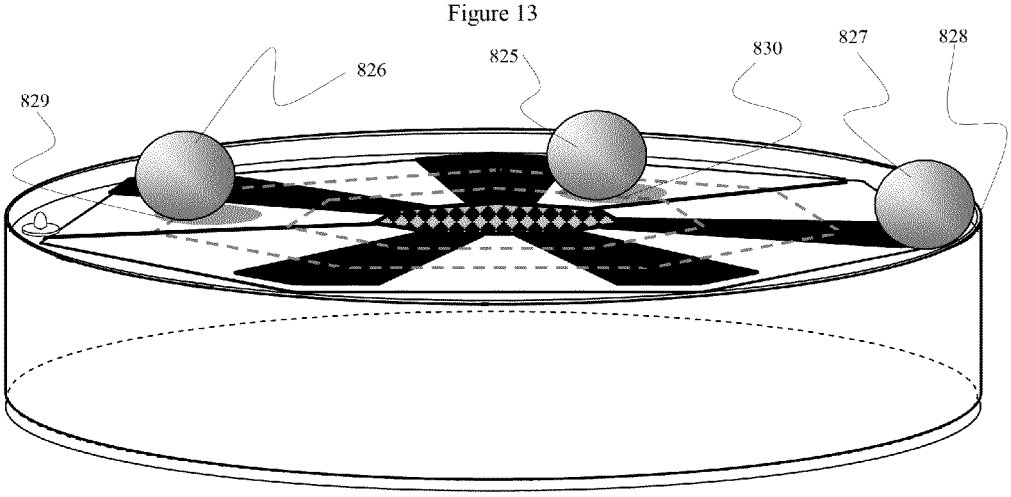
FIG. 13 illustrates a ball being used to create random musical notes.

The musical notes are generated by the integrated circuits IC1 204, IC2 205, and IC3 206. The actual frequency of the notes produced are shown in FIG. 5 in columns @out1 506, @out2 505, and @out3 504. All outputs have a final division of 2 to insure a square wave output as shown in FIG. 6 for V1 609, V2 610, and V3 611. FIG. 5 chart uses clock frequencies of 2000240 501, 1000120 502, 500060 503 to produce three consecutive octaves from three separate integrated circuits 508-510, 405-407 each designed to generate a musical octave. The schematic layout shown in FIG. 2 places the notes one octave apart next to each other on the rings 309-311 of notes. The same results could be obtained using an integrated circuit 975 as shown in FIG. 11, with a clock generator 976 and an audio circuitry 977 in the integrated circuit 975 package 978. This integrated circuit 975 does not allow for electronic shifting of notes.

Figure 4:
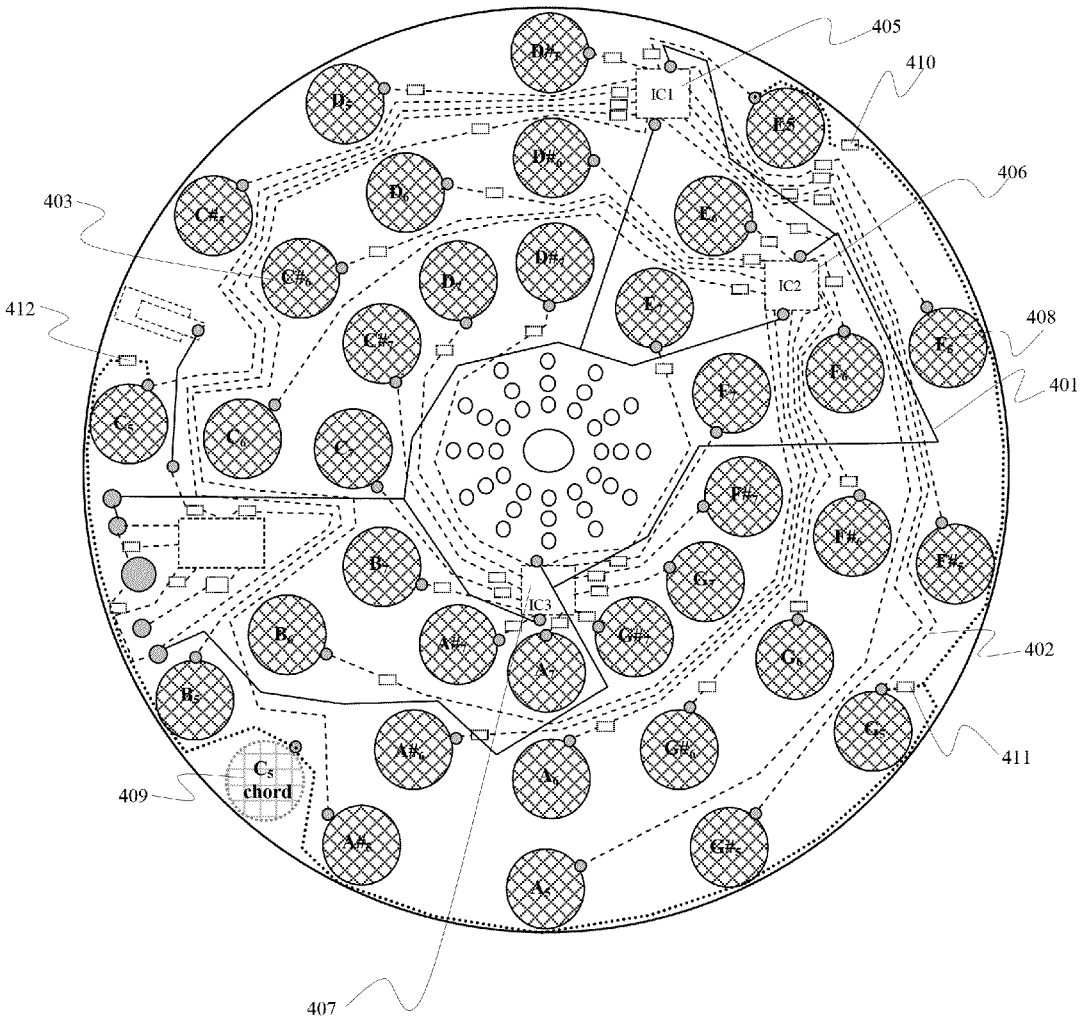
FIG. 4 illustrates the double-sided printed circuit board layout showing the top conductive connection paths as solid lines and the bottom components and paths as dashed lines.
Figures 9, 10:
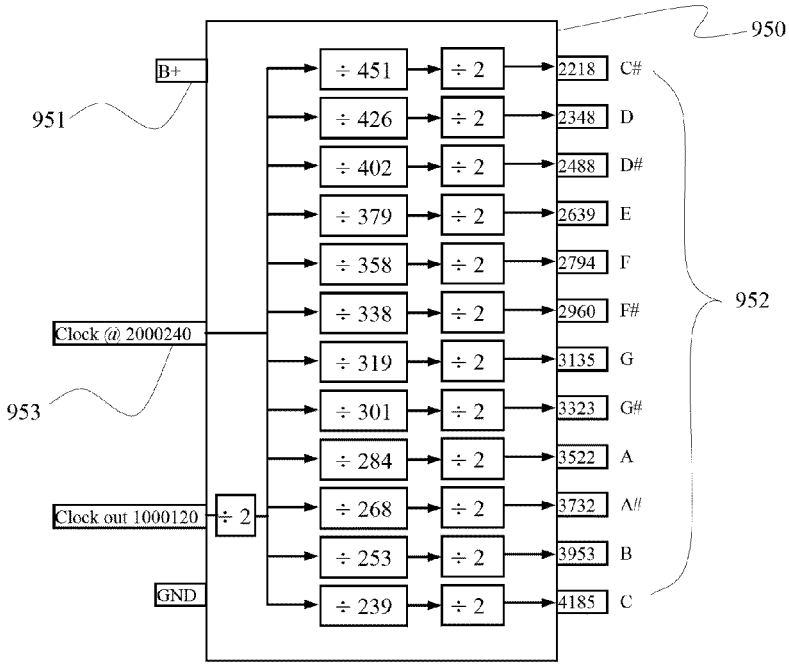
FIG. 9 illustrates a frequency chart showing integrated circuit clock inputs and shifted octaves or output frequency columns for IC1 and IC3 at printed circuit contact areas.
FIG. 10 illustrates an integrated circuit block diagram of a top octave generating integrated circuit showing note frequencies and clock frequency.

FIG. 4 represents a more detailed view of the fourth layer 304. The fourth layer (the printed circuit board) 304 may have a plurality of note pads 316. By changing the clock frequency 903 of the outer ring integrated circuit 405, 204 and the clock frequency 901 of the inner ring integrated circuit 407, 206 as shown in the FIG. 9 chart, the musical notes are shifted on the inner ring 309 and outer ring 311 to place notes next to different notes in the middle ring 310 that are no longer related by an octave or a factor of two. For example note $A_6$ 906 is between note $C_8$ 905 and $D\#_6$ 907 after switches SW1 209 and SW2 210 are switched to new clock generators 211, 212. By using sixteen pin 951 integrated circuits 950 the notes 952 in each octave can be shifted by changing the clock frequency 953 for that integrated circuit 950. Another advantage of using a one octave integrated circuit generator 950, 405-407, 204-206 is they are placed in different areas of the fourth layer 304 and make connections to note pads 316, 403 easier.

Another advantage of this invention is the ease of adding cord pads 409, 996. A simple addition of diodes D1 993, 412, D2 994, 410, and D3 995, 411 produces a musical C chord 996 on the C chord pad 409 but still isolates the pads producing the chord. These diodes 993-995 could also be added inside an integrated circuit with 64 pins allowing 16 additional chord outputs.

In an embodiment, various small visual overlays 700 may be placed over the top of the keyboard 101. The small visual overlays 700 may be aligned by an opening 703 in the small visual overlay 700 which aligns with an LED 155 of the top 102 of the device 100. The overlays 700 may have numbers 705 which teach the sequence of notes to play a song. The visual overlays 700 may also have colored areas 702 to match notes in a musical chord. If a note is used in more than one chord, the visual overlay 700 may use more than one color over a pad 704 to show it is used with both blue pads 702 and red pads 711. Colors may also be placed over chord pads 409, 906 when they are used. In an embodiment, the visual overlay 700 is generally planar and generally circular. Further, the visual overlay 700 may be of substantially the same size and shape as the first layer 301 so as to substantially cover the first layer 301 when the visual overlay 700 is used.

Referring now to FIGS. 8*a* and 8*b*, a user may move his or her hand in an up and down manner over the loudspeaker 802. More specifically, when playing music on the device 100, the hand 801 move from a First Position A (FIG. 8*a*) to a Second Position B (FIG. 8*b*) over the loudspeaker 802 therein slightly muting or creating a vibrato effect with respect to the sound coming out of the loudspeaker 802.

In an embodiment, a second loudspeaker 188 (FIG. 1) may be located along the generally cylindrical exterior side surface 104 of the device 100. An electric switch 189 located on the device 100 may allow a user to elect between utilizing the centrally located loudspeaker 106, 203, the second loudspeaker 188 located on the generally cylindrical exterior side surface 104, or both. Allowing the user to select between the centrally located loudspeaker 106, 203, the second loudspeaker 188, or both allows a user to control the muting, vibrato effect of the sound or remove all muting or vibrato effect.

A user may place small balls 825-827 of significant weight, such as marbles or ball bearings, over the keyboard 101, 805 and in the area used by the hand 801 to play songs. By tilting the musical instrument 100 the balls 825, 827 will move and may roll over playable areas 829, 830 producing random notes or chords. These balls would not fall off the musical instrument 100 as a result of being retained by a top rim 112, 806, 828 on the musical instrument 100.

Although the musical instrument 100 has been shown using a round shape, the instrument is not limited to this shape and could also have been square, polysided, star-shaped, and triangular shaped, to name just a few. Accordingly, although the device has been described by reference to a preferred embodiment, it is not intended that the novel musical instrument be limited thereby, but that modifications thereof are intended to be included as falling within the broad scope and spirit of the forgoing disclosure, the following claims and the appended drawings.

The invention claimed is:

1. An electronic musical instrument comprising:

a housing having a top, a bottom, a center and a generally cylindrical side and an interior;

a circular keyboard having a plurality of layers wherein the circular keyboard is located at the top of the housing;

wherein one of the plurality of layers of the circular keyboard has keys wherein the circular keyboard displays at least one octave of musical notes wherein the octave of musical notes are aligned in one of a plurality of bands of concentric rings wherein a first note of an octave of a first band is adjacent to an identical first note of another octave of a second band; and a generally cylindrical support located within the interior of the housing at the center of the housing wherein the generally cylindrical support supports the circular keyboard above the bottom of the housing and wherein the generally cylindrical support contains a loudspeaker wherein the loudspeaker produces an audible sound based on the notes played on the circular keyboard.

2. The electronic musical instrument of claim 1 further comprising:

an integrated circuit electronically connected to the circular keyboard wherein the integrated circuit is located within the interior of the housing wherein the integrated circuit simultaneously generates one or more octaves of musical notes.

3. The electronic musical instrument of claim 2 wherein the notes in one of the plurality of bands of the concentric rings are shifted electronically with respect to the other bands by shifting a clock input of the integrated circuit which creates the notes for that octave.

4. The electronic musical instrument of claim 1 further comprising:

a conductive pad located beneath one of the layers of the circular keyboard wherein the conductive pad is electrically connected to an integrated circuit.

5. The electronic musical instrument of claim 1 further comprising:

a generally circular overlay layer of substantially the same size as the circular keyboard wherein the generally circular overlay is placed over the circular keyboard and wherein the generally circular overlay has a plurality of numbers, colors, or other indicia for assisting a user in learning to play a song.

6. The electronic musical instrument of claim 5 further comprising:

an LED located on the first layer of the circular keyboard wherein the LED has a diameter;

an opening having a diameter located on the generally circular overlay layer wherein the diameter of the opening of the generally circular overlay layer is the same as the diameter of the LED such that the LED may snugly fit through the opening of the generally circular overlay and wherein the generally circular overlay is prevented from moving with respect to the first layer of the circular keyboard when the LED is located in the opening of the generally circular overlay.

7. The electronic musical instrument of claim 1 wherein the electronic musical instrument is water resistant.

8. The electronic musical instrument of claim 1 further comprising:

a generally circular rim extending above the circular keyboard wherein the generally circular rim has a circumference equal to a circumference of the housing and wherein the generally circular rim extends from the generally cylindrical side of the housing;

a generally spherical ball placed over the top of the housing wherein the generally spherical ball rolls over and activates the circular keyboard and produces random notes; and wherein the generally circular rim prevents the generally spherical ball from falling off the circular keyboard.

9. The electronic musical instrument of claim 1 further comprising:

an additional key which is added to the circular keyboard wherein the additional key allows a user to play common chords by pressing only one key.

10. The electronic musical instrument of claim 9 wherein a chord may be changed electronically by shifting a clock input of an integrated circuit.

11. The electronic musical instrument of claim 1 further comprising:

an electronic loudspeaker located on the generally cylindrical side of the housing.

12. The electronic musical instrument of claim 1 wherein the keys of the circular keyboard are triangular in shape and wherein the keys become broader the closer the keys are to the cylindrical side of the housing.

13. The electronic musical instrument of claim 1 further comprising:

a second loudspeaker wherein the second loudspeaker is located on the generally cylindrical side of the housing; and a switch located on the housing wherein a user may use the switch to determine if the loudspeaker at the center of the housing is activated, the second loudspeaker of the generally cylindrical side of the housing is activated or both are activated.

14. An electronic musical instrument comprising:

a housing having a top, a bottom, a center and a generally cylindrical side and an interior;

a circular keyboard having a first layer, a second layer and at least a third layer wherein the circular keyboard is located at the top of the housing;

wherein the first layer of the circular keyboard has keys and wherein the first layer of the circular keyboard displays at least one octave of musical notes wherein the octave of musical notes are aligned in one of a plurality of bands of concentric rings; and a generally cylindrical support located within the interior of the housing at the center of the housing wherein the generally cylindrical support supports the circular keyboard above the bottom of the housing and wherein the generally cylindrical support contains a loudspeaker wherein the loudspeaker produces an audible sound based on the notes played on the circular keyboard.

* * * * *